United States Patent [19]

Chow

[11] Patent Number: 5,058,330

[45] Date of Patent: Oct. 22, 1991

[54] SELF-SUPPORTING MEMBRANE STRUCTURE FOR USE ON THE MOON

[75] Inventor: Philip Y. Chow, Orinda, Calif.

[73] Assignee: T. Y. Lin International, San Francisco, Calif.

[21] Appl. No.: 348,203

[22] Filed: May 5, 1989

Related U.S. Application Data

[63] Continuation-in-part of Ser. No. 123,268, Nov. 20, 1987, abandoned.

[51] Int. Cl.[5] ..... E04G 11/04

[52] U.S. Cl. ..... 52/2.11; 52/169.1; 52/169.14; 52/169.6

[58] Field of Search ..... 52/169.1, 169.6, 169.14, 52/2 R, 2 A, 2 B, 2 C, 2 D, 2 E, 2 F, 2 G, 2 H, 2 J, 2 K, 2 L, 2 M, 2 N, 2 P

[56] References Cited

U.S. PATENT DOCUMENTS

| | | | |
|---|---|---|---|
| 2,743,510 | 5/1956 | Mauney et al. | 52/2 X |
| 2,755,630 | 7/1956 | Freyssinet | 52/169.6 |
| 4,016,702 | 4/1977 | Nakada et al. | 52/2 X |
| 4,299,066 | 11/1981 | Thompson | 52/236.2 X |
| 4,519,176 | 5/1985 | Britz | 52/169.11 X |
| 4,730,797 | 3/1988 | Minovitch | 52/2 X |

FOREIGN PATENT DOCUMENTS

| | | | |
|---|---|---|---|
| 564843 | 7/1957 | Italy | 52/169.1 |
| 85/04211 | 9/1985 | PCT Int'l Appl. | 52/169.1 |

OTHER PUBLICATIONS

Pneumatic Structures—A Handbook For the Architect and Engineer, Herzog, Thomas, p. 100, FIG. 274–275.

Principles of Pneumatic Architecture, Dent, R. N., John Wiley & Sons, Inc., N.Y., pp. 177–179.

Pneumatic Structures, Herzog T., Crosby, Lockwood, Staples, London, pp. 156–157, 1976.

*Primary Examiner*—John E. Murtagh

*Assistant Examiner*—Deborah McGann Ripley

*Attorney, Agent, or Firm*—Owen, Wickersham & Erickson

[57] ABSTRACT

A self-supporting pressurized or unpressurized membrane structure for lunar habitation and operation. The pressurized membrane is made up of continuous and leak-proof fabric membrane that encapsulates the entire structure and is capable of withstanding temperatures of about −190° C. to about +140° C. this structure has a skin preferably made up of two-spaced apart fibrous skins with a latticed web between them and foam material filling the space between the skins. Lunar soil supports the lower portions of the spherical, spheroidal, by means of a compression ring beam, or arched structure, and a lunar soil cover of up to ten feet covers the structure. The unpressurized membrane structure has a double-skin membrane arch or dome that derives its structural strength from structural foam injected into the double-skin wall of the roof.

16 Claims, 8 Drawing Sheets

FIG. 5
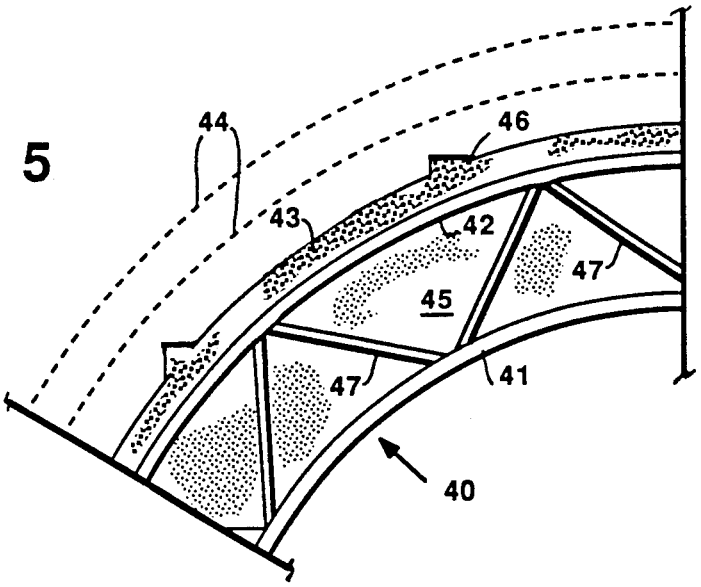
FIG. 7
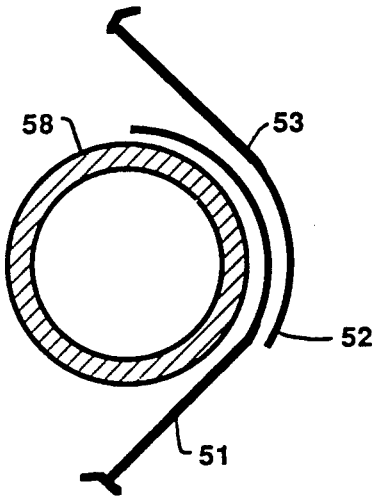
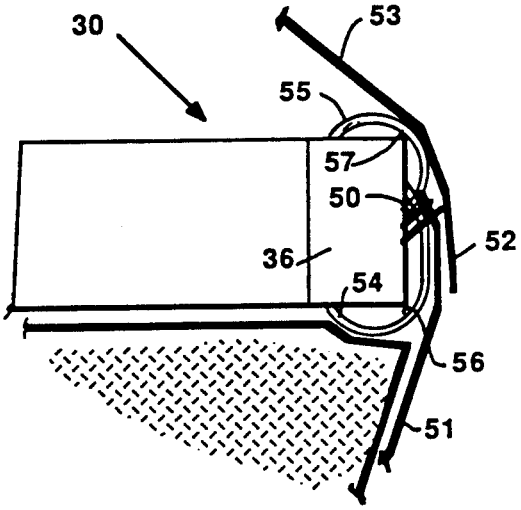
FIG. 6

SELF-SUPPORTING MEMBRANE STRUCTURE FOR USE ON THE MOON

This application is a continuation-in-part of application Ser. No. 07/123,268, filed Nov. 20, 1987 now abandoned.

This invention relates to a self-supporting membrane structure for use on the moon.

BACKGROUND OF THE INVENTION

In general, one of the problems preventing occupation of the moon by people from earth is that of providing semi-permanent or permanent structures for the lunar base.

Among the differences between the moon and the earth is the fact that the gravity of the moon is only about one-sixth that of the earth. Moreover, there is an extreme temperature range on the moon. At the surface, temperature ranges from about −190° C. at night to about +140° C. during the day. Moreover, it should be noted that a lunar day is equivalent to about twenty-eight earth days.

The cost of transporting material to the moon is very high, estimated currently at about $4,000 to $5,000 per pound. Therefore, the construction material must be extremely light. However, in this connection, an important point to bear in mind is that there is no atmosphere and therefore no atmospheric pressure on the moon. Nor are there any moisture, bacteria or chemical corrosion. Hence, structures which might be unsuitable on earth can be practical on the moon.

The soil density of the moon is irregular, whether considered vertically or horizontally. On the maria or plain, bedrock may not be encountered within 200 feet below the surface. Moreover, the moon surface is covered with a porous layer of dust. A spread footing or a raft that bears directly on the soil could be a suitable foundation, but conventional rafts and footings made of steel or concrete raise problems in transporting because of their bulk and weight.

Moonquakes occur, although they are less severe than earthquakes.

Among the special hazards that occur on the moon are the bombardment by micro-meteoroids, erosion by the abrasive micro-meteoroids, dust adherence, cosmic radiation from the galaxy on the lunar surface, and also the more important solar radiation. Structures will need protection from these hazards.

Finally, lunar construction must necessarily be accomplished at a minimum elapsed time and with a minimum of labor, in order to reduce the hazards of exposures and the economic cost.

SUMMARY OF THE INVENTION

The invention comprises both inflated or pressurized structures and unpressurized structures. For example, it includes an inflated or unpressurized fabric sphere or spheroid of any suitable size protected by a cover of lunar soil up to about ten feet thick. A true sphere of this invention may be as much as forty feet in diameter, so long as excavation to provide its base and the height of covering lunar soil is limited to about twenty feet to provide a gentle slope. A prolate (or oblate) spheroid may be a preferred alternative shape of any size if the headroom and the depth of excavation accompanying a spheroid structure would have to be reduced. This flatter sphere-like form may be circular in plan but shaped somewhat like a football in longitudinal vertical section for enclosure of large areas, for example, a community hall about one hundred feet in diameter. Larger enclosures become possible by increasing the depth of excavation or by locating the enclosure at a higher level.

The structure preferably comprises multi-layer fabric walls with lightweight insulating-cum-structure foam between layers, constituted so that they can stand up, especially when inflated, in safety to the hostile environment of the moon for twenty or thirty years, or longer, if necessary. Such a fabric structure meets the design requirements for lunar structures as follows:

(1) Its wall structure is light in weight. Fabric is not only light in weight but is strong in tension. Such fabric can be made from a variety of material such as aramid (an aromatic polyamide) or a reinforced glass filament/silicone rubber composite. The latter fabric preferably has a tensile strength of up to 10,000 psi for a 100-foot diameter enclosure. It can act as its own raft or footing.

(2) The structure is capable of good resistance against the extreme temperatures to be encountered. Already available in the marketplace are aramid or glass filament-silicone fabrics that have an operating range of about −73° C. to +260° C. Formulations can readily be devised from what is known now to achieve the required strength and to function at the projected lower temperature of −190° C.;

(3) The structure can be installed so as to overcome the difficulty brought about by soil irregularity. The self-supporting structure of this invention needs no special foundation. In forms adapted for human occupation, it is preferably retained by internal pressure. It does not impose any pressure sideways, because it is a pressure-retaining structure. Therefore, the internal pressures neutralize themselves in all directions.

The pressurized fabric structure, when properly installed, has the following advantages:

(1) The self-supporting membrane structure achieves economy, because it supports itself and the soil cover on the roof with an internal pressure of about 14 psia of air—the air pressure that would be needed to simulate a shirt-sleeve working environment on the earth.

(2) The device is installed in an excavation, and the excavated soil is then restored as a protective cover over the structure, against such hazards as meteorite bombardment and difficulties from radiation. A soil cover up to ten feet thick over the self-supporting membrane structure would weight only about 1.0 psi on the moon and is but a fraction of the 14 psia internal pressure recommended for supporting the structure.

(3) The open and spacious interior of the enclosure enables the accommodation of equipment and human activities that may require large spaces and head room.

(4) The self-supporting membrane structure also lends itself to rapid installation. About the only lead time required would be the preparation of the site that is to receive the structure. Such preparation comprises mainly the excavation of the site to a required depth. Since a 40-foot diameter self-supporting membrane structure weights only about 2,000 pounds on the moon, it can possibly be transported and handled in one piece by lightweight equipment. Larger self-supporting membrane structures may have to be transported in sections and assembled and welded together on site.

The pressurized structure preferably includes not only the basic sphere and flattened or prolate spheroids but also dividing of the sphere or spheroid into a soil bag in the lower hemisphere and a working surface, which can begin below the centerline and be quite level. The structure itself is described in more detail below.

The method of installation of pressurized structure includes the steps of excavation, placement of the as yet non-inflated self-supporting membrane structure, then the inflation (when used) thereof sufficient to bring about the spherical or spheroidal form, whether somewhat flattened or not. Inflation is followed by pressure-grouting of the interstices between the double-skin wall with structural foam back-filling the sides with lunar soil and compacting the soil there. The soil bag is then filled with lunar soil, and air locks may be installed to prepare the floor. Equipment is then brought in, and the inflated structure is pressurized to the desired amount, e.g., about 14 psia. Then the structure may be covered with an up to ten-foot layer of soil.

There may also be unpressurized structures that are self-supporting, use for storage and protection of materials and equipment and not for human habitation or as work rooms. These are made of web membrane arches or domes stiffened by structural foam injected into spaces between layers of a double-skin roof.

BRIEF DESCRIPTION OF THE DRAWINGS

FIG. 5 is a fragmentary view in elevation and in section of a double-skin membrane structure for the structures of FIGS. 1–4.

FIG. 6 is a fragmentary view of a detail showing the structure of a ring girder with a made-up section, for use in a structure like that of FIGS. 3 and 4.

FIG. 7 is a fragmentary view of a structure alternative to FIG. 6, employing a ring girder in the form of a pipe.

DESCRIPTION OF A PREFERRED EMBODIMENT

Figure 1:
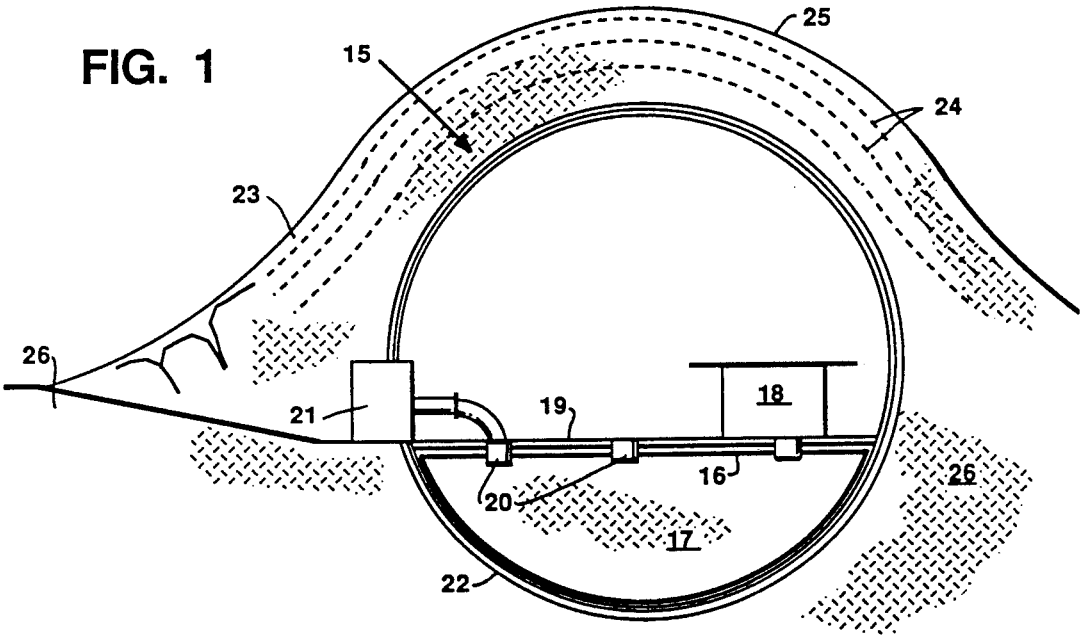
FIG. 1 is a view in elevation and in vertical section of a pressurized self-supporting membrane structure embodying the principles of the invention.
Figure 2:
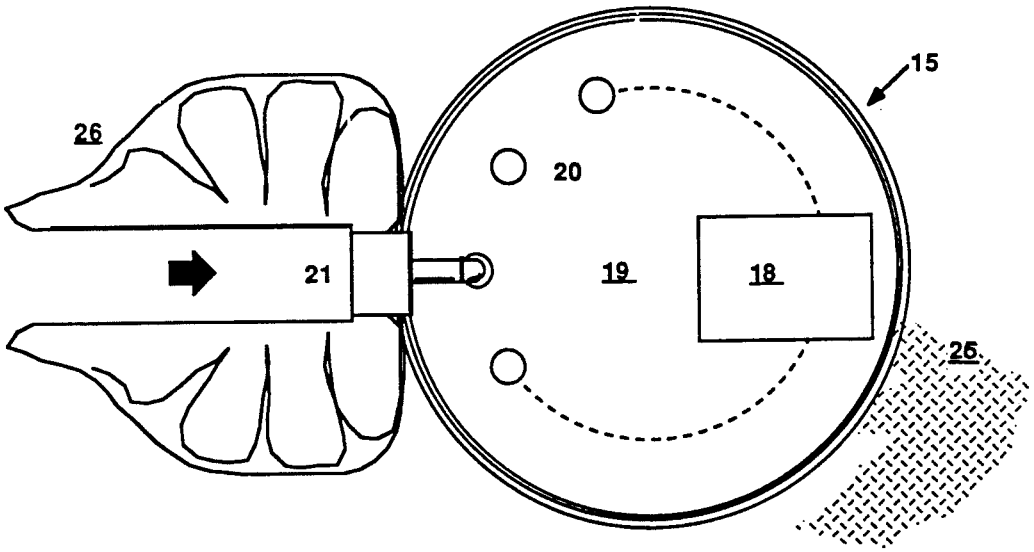
FIG. 2 is a view in horizontal section of the structure of FIG. 1.

The spherical pressurized structure of FIGS. 1 and 2

The structure 15 of FIGS. 1 and 2 employs a multilayer sphere with its skin made from a suitable leakproof fabric such as a composite of fiberglass and silicone, preferably having plural membrane layers as in FIG. 5. As shown, in inner bag 16 is filled with soil 17, and a prefabricated upper deck unit 18 is provided above a floor 19. There may be a filling port 20 and a pressure air lock 21.

The membrane structure 15 is fitted into an excavated pocket 22 and covered with soil 23, preferably with a series of layers of soil reinforcing fabric 24 between the structure 15 itself and the top surface 25 of the soil 23 During the placement and (if necessary) completion of manufacture of the structure 15, there may be an inclosed conveyor system (not shown) for both excavating the virgin lunar soil 26 and for refilling and covering the structure 15 with soil 23. If desired, part of the span occupied by the soil bag 16 may be used as storage space or room for additional machinery and equipment.

As shown in FIG. 2, there may be various filling ports 20. The excavation depth does not exceed twenty feet, and the handling equipment available after having been used for excavation, may be stored in another such structure or stored in part of the space occupied by the soil bag 16.

Figure 3:
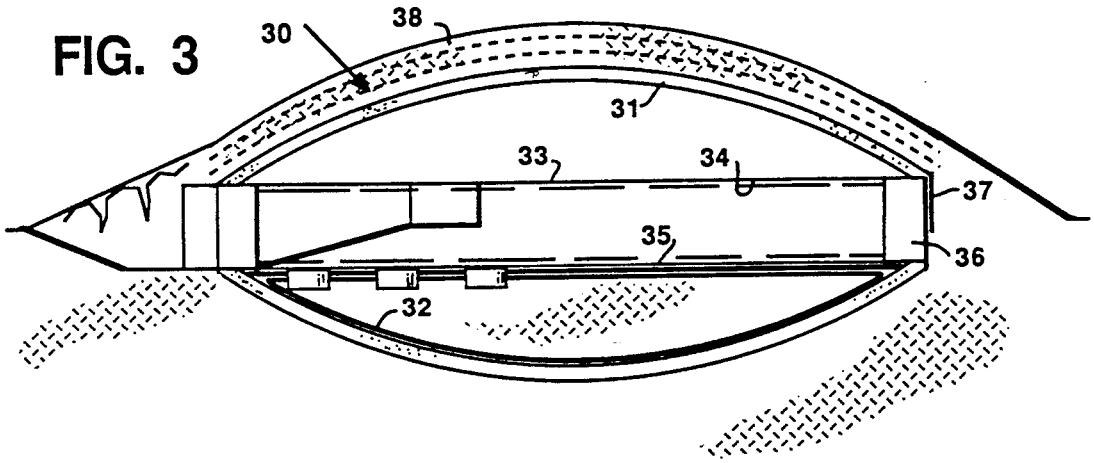
FIG. 3 is a view similar to FIG. 1 of a somewhat flattened membrane structure embodying the principles of the invention.
Figure 4:
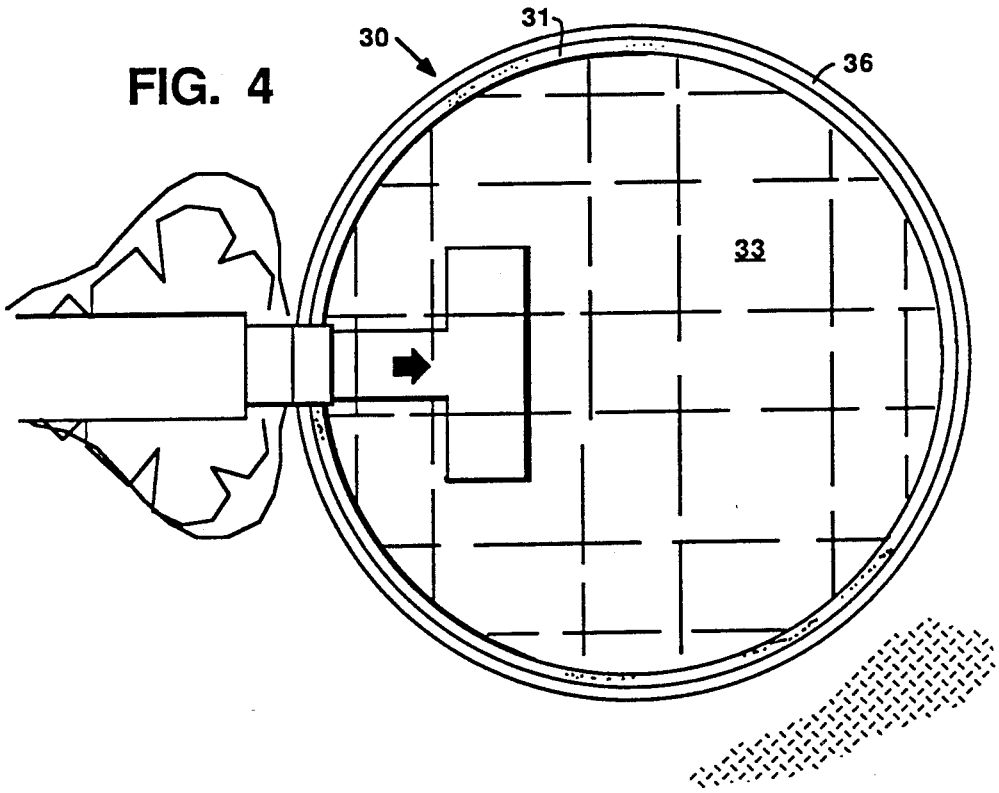
FIG. 4 is a view in horizontal section of the structure of FIG. 3.
Figure 8:
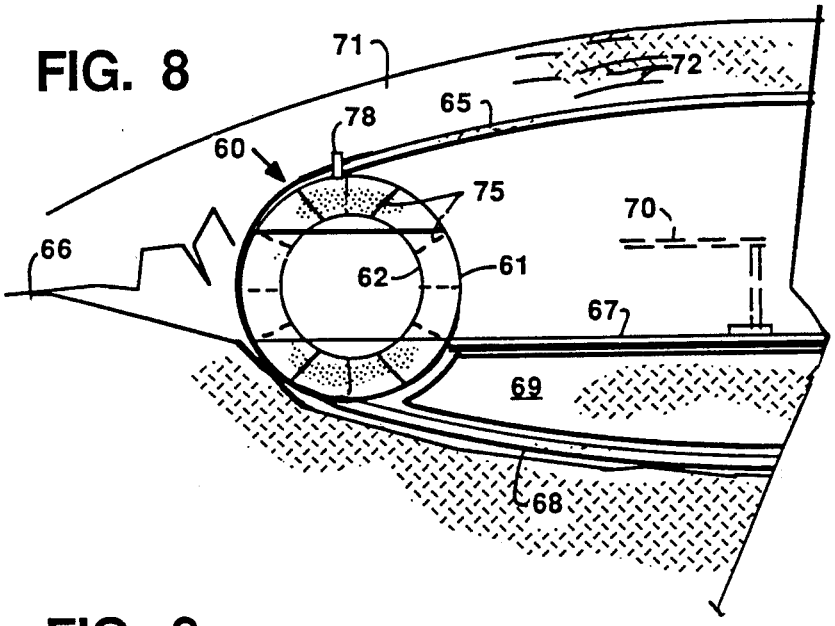
FIG. 8 is a view in vertical front section of a prolate spheroid type of structure according to the invention employing a circular inflatable membrane ring girder with the same construction as the main structure.
Figure 9:
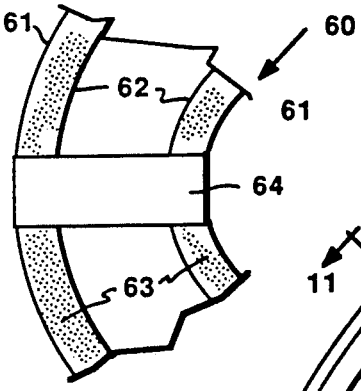
FIG. 9 is a short sector in plan of the ring girder structure of FIG. 8.
Figure 10:
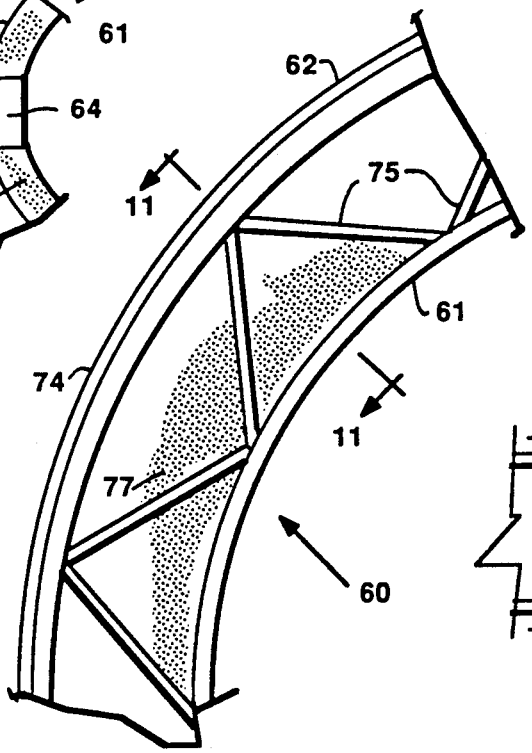
FIG. 10 is a fragmentary view in horizontal section of a ring girder employing a latticed web type structure.
Figure 11:
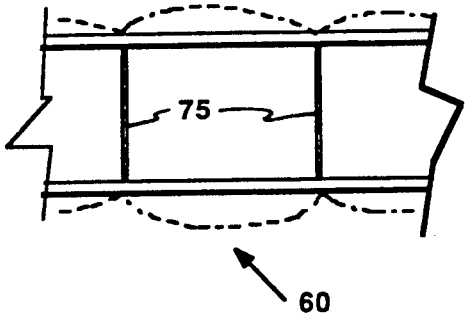
FIG. 11 is a fragmentary view in section taken along the line 11—11 in FIG. 10 of a portion of the ring girder with the latticed web.

The flattened larger pressurized self-supporting membrane structure, FIGS. 3 and 4

FIGS. 3 and 4 show a structure 30 that, from side elevation, looks somewhat like a football but from the top plan appears as a circle. In other words, it is a structure which approaches a prolate spheroid. The structure 30 is basically the same as that of FIGS. 1 and 2 with a membrane 31 having plural membrane layer with a soil bag 32 below a floor 33. In this instance, a storage floor 34 is shown, as an example, with a main floor above that, leaving a spacing of about ten feet between the floors 34 and 35 for storage above the soil bag 32. As will be seen, there may be a compression ring girder 36 around the rim 37 of this structure to resist the inward pull on the girder by the top and bottom membranes, since it is not a true sphere. Like the structure 15 of FIGS. 1 and 2, there is a cover of up to ten feet of the lunar soil 38.

The plural structure of FIG. 5

FIG. 5 shows a possible structure in which the membrane 15 or 30 comprises a plural structure 40 with two separated layers 41 and 42, each of glass film and silicon fabric or something equal to or better than that in strength and temperature resistance and resistance against degradation due to radiation. A covering layer 43 of lunar soil, with membrane layers 44, covers the membrane 40. Preferably the inner layer 41 is spaced from the outer layer 42 and the space is filled with structural insulation 45 that may be pumped in between the two layers 41 and 42. The insulation 45 may be structural foam, polyurethane, or other suitable material and may be applied only after the membrane 40 has been pumped up sufficiently to assume the inflated shape. Outside the outer layer 41 there may be a covering 46 of antiradiation, abrasion-resistant, puncture-resistance and self-healing membrane, which is suitable for contact with the lunar soil. The inner and outer walls 41 and 42 may be collapsible latticed webs which are installed in advance so that the structure 15 or 30 can be brought from earth intact and as a completed assembly, except for minor points such as opening the ports through which the pressure is provided, etc.

For a purely spherical structure 15, no further internal supports are needed, except perhaps the floor 19, which may be provided for walking and support of equipment. The inner soil bag 16 is also preferably a separate bag, as shown earlier.

Ring Girders, FIGS. 6–11

As shown in FIG. 6, when the larger prolate spheroid type of structure is used, the membrane 30 may be supported by a ring girder 36. This can be designed for any particular size or shape of structure that is desired. A recess anchor 50 may be provided for a bottom membrane portion 51, and a lap 52 between a top membrane 53 over the bottom membrane 52. The bottom membrane 51 is preferably secured to or fastened to the ring girder 36, while a portion 52 of the top membrane 53 is lapped over and then welded to the bottom membrane 51. There may be shaped membrane portions 54 or 55 around the corners 56 and 57 of the ring girder 36 for support of the membranes 51 and 53 and for minimum of friction and wear.

Figure 19:
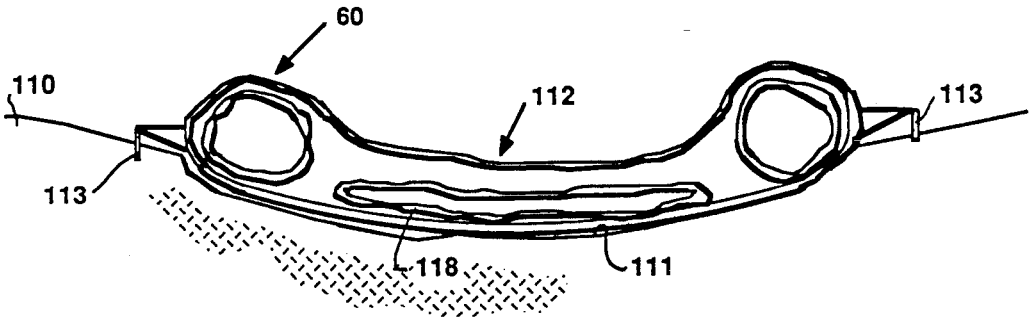
FIG. 19 is a view in side elevation and in section illustrating the first stage in an alternate method of installation of a pressurized self-supporting membrane structure of the invention, using an inflatable ring girder made with the same fabric material with the same double-skin wall structure.
Figure 20:
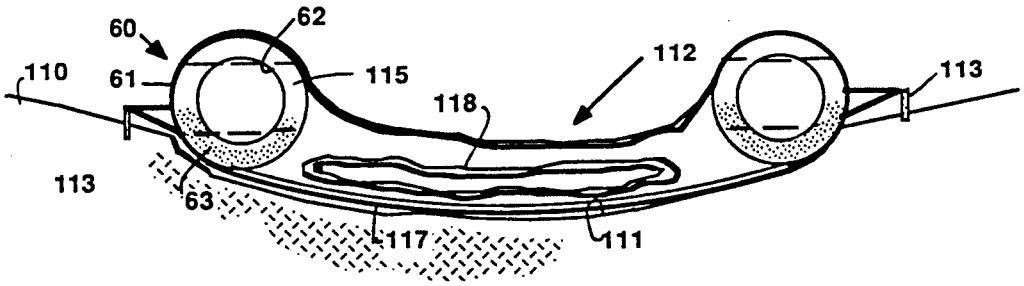
FIG. 20 illustrates the structure of FIG. 19 at a later stage of installation.
Figure 21:
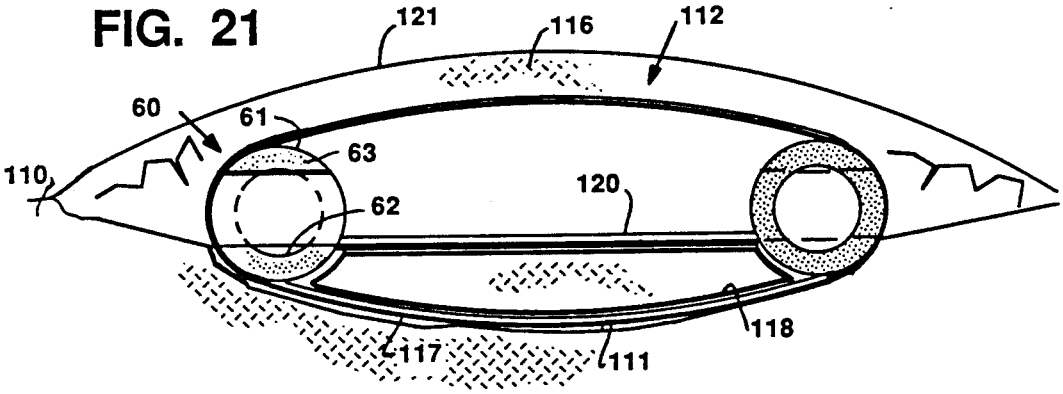
FIG. 21 is a similar view indicating the structure of FIGS. 19 and 20 at a final stage of installation and erection.

As FIG. 7 shows, the ring girder may comprise a pipe 58 which may, for example, be about three feet in diameter and hollow, with the bottom membrane 51 secured to it and the top membrane 53 lapped and secured in the manner described in connection with FIG. 6. It may be made of inflatable structure with the same construction as the main enclosure, as shown in FIGS. 19, 20, and 21.

A compression ring girder is often a very important part of self-supporting membrane structure, especially in the larger diameter devices. Among its other functions, it also provides the best means for accommodating penetrations and accesses, such as air locks, to the structure. For this reason the prolate spheroid shape is preferred over the beamless spheres for pressurized self-supporting membrane structures that are forty feet in diameter and smaller, as well as for the larger structures.

As can be seen in FIGS. 8–11 where the alternative collapsible ring girder 60 is employed. The ring girder 60 may be made of the same plastic as the skin of the sphere or spheroid of FIGS. 1–4. As shown especially in FIG. 9, the ring girder 60 may be a toroid circular in cross-section and may be provided with a pair of skins, an outer diameter skin portion 61 and an inner diameter skin portion 62 with structural foam 63 applied between the skins 61 and 62. there may be an air lock 64 (which may be generally like the air locks used in space vehicles) at one or more points along the circumference of the ring girder 60. For example, the compression ring girder 60 may be twelve feet in diameter with the two skin portions 61 and 62 spaced two feet apart with structural foam 63 filling it and with the air lock 64 about six feet square as a passageway between the interior and exterior of the spheroid 65 in FIG. 8.

The spheroid 65 (or a sphere, if used) may be made without the laps, shown in FIG. 7. The ring girder 60 may go below the normal level 66 of the lunar surface, which is shown to be at the middle of the prolate spheroid 65 in FIG. 8, but also below a level-adjustable flooring 67 and encircles the preformed plastic bag 68 that is filled during erection with lunar soil 69. Above the level-adjustable flooring 67 there may be an additional prefabricated floor 70, if desired or required. The outer surface of the structure 65 may be covered over with a soil cover 71, up to about ten feet thick, preferably with soil stabilizing fabric layers 72 inserted at various depths in the soil cover 71, for example, a layer 72 every foot. The structural foam may have a density of twenty to forty PCF. Pressure relief valves 78 may be applied at a various high points locations around the structure.

As shown in FIGS. **10*b* and 11, the ring girder 60 may have its own protective coat 74** to give protection from radiation and abrasion.

The pressurized inflated structure of this invention may result in the complete capsulation (wrap-around) around) of the enclosed space. In other words, a pressure-resisting membrane completely envelopes the structure, instead of terminating at floor levels. Another unique feature, is the strengthening and stiffening of a collapsible, weak membrane arch or ring girder with pressure-injected structural foam into the double-skin wall.

These features make the structure easily erectable, light, and flexible as to size.

The two skin layers 61 and 62 may be helped in retaining their shape by a latticed web 75 of plastic. The double-layer skin of the structure 65 may also have a latticed web therein. The interstices 76 between the web portions may first be charged with air or other suitable gases and then filled with sprayed structural foam 77. The membrane 61 (or that of the member 65) will typically bulge after it has been filled with the foam 77.

Figure 12:
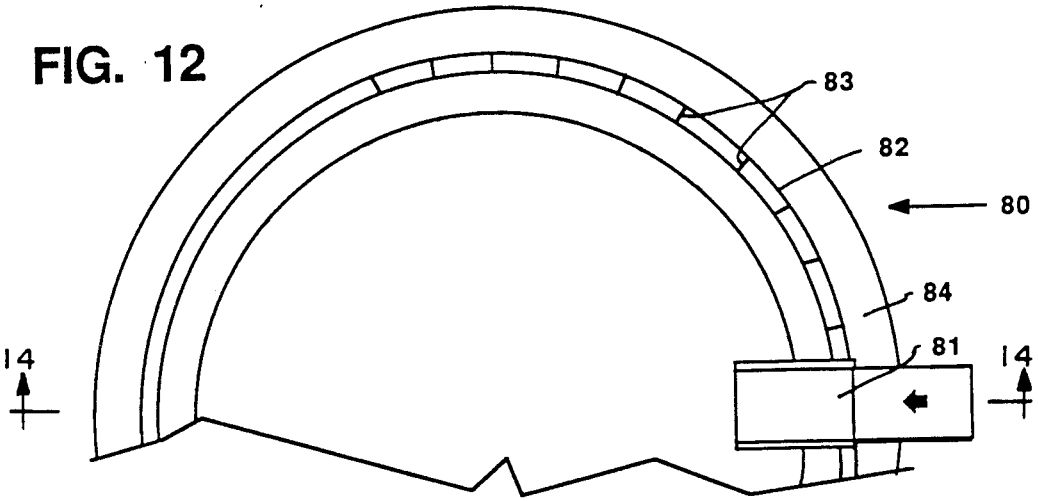
FIG. 12 is a view of an unpressurized self-supporting membrane structure embodying the principles of the invention, the structure here being of the dome type with the bottom portion cut off in order to conserve space.
Figure 13:
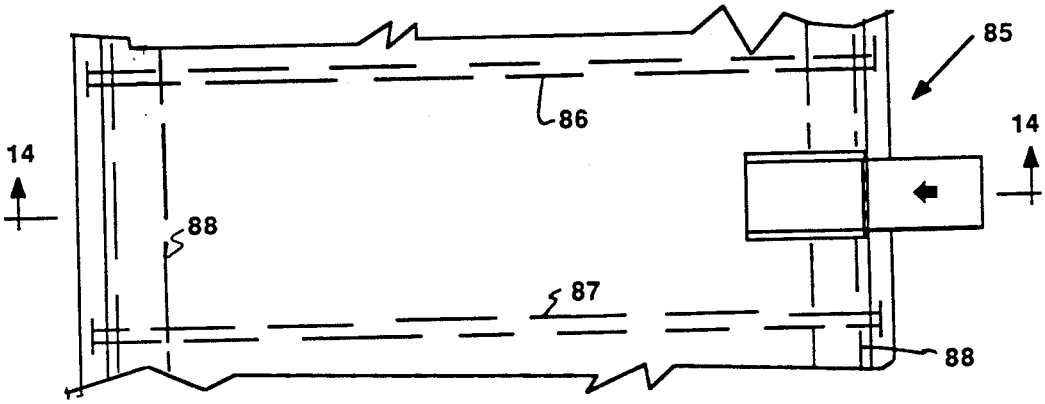
FIG. 13 is a plan view of a tunnel type of unpressurized self-supporting membrane structure of the invention.
Figure 14:
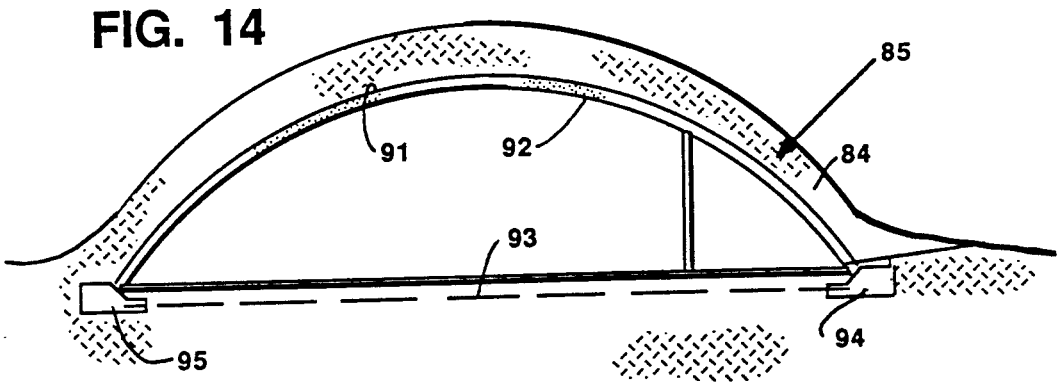
FIG. 14 is a view in vertical section along the line 14—14 in FIG. 12 and 13 of a dome, or tunnel-type of unpressurized self-supporting membrane structure.

Unpressurized structure—FIGS. 12–14

In addition to the pressurized self-supporting membrane structures heretofore discussed, an unpressurized self-supporting structure may be used. The idea of forming the walls with structural foam applies just as well to unpressurized enclosures as to pressurized ones. Storage buildings, parking yards for vehicles and equipment, and other such lunar structures are contemplated in view of the necessity of protecting these from meteoroid damage when not in use.

Since there is no internal pressure, the membrane for an unpressurized structure does not have to wrap around the underside of the structure. All that is required is to secure its circular roof membrane structure after the wall has been filled with foam in order by fixing and anchoring it to a tied base block at the bases of the wall.

Thus, in FIG. 12, there is a dome type structure 80 with an entrance 81. The footing width varies. A double skin wall 82 is connected by latticed webs 83. The entire structure is buried beneath at least up to ten feet of lunar soil 84.

A tunnel type of structure 85 is shown in FIGS. 13 and 14, may be used in which there are ties 86 nd 87 made of strong plastic cables between skin elements 88.

FIG. 14 shows a structure 90 comprising a double skin wall 91 filled with structural foam 92 and forming an arch or spheroid segment. Ties 93 are used only for the tunnel type of structure; there is a footing 94 and 95 formed by structural foam to which is joined the double skin wall 91.

Figure 15:
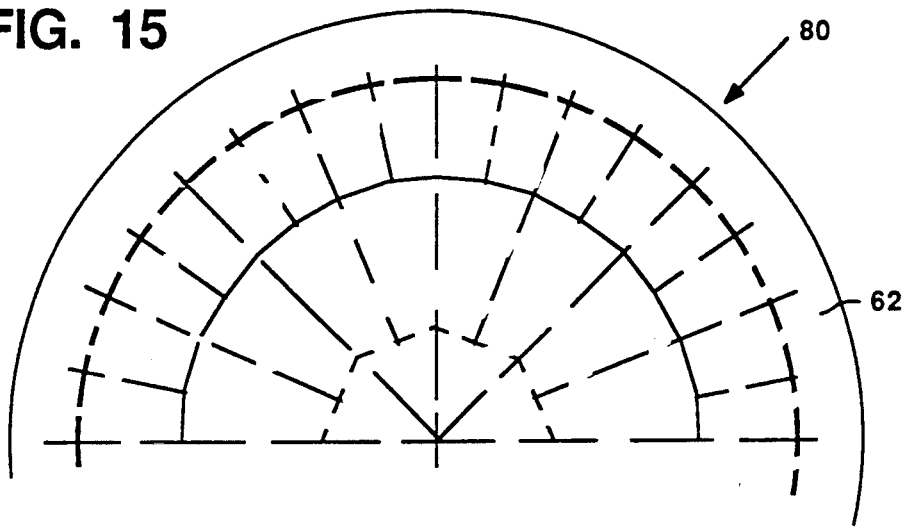
FIG. 15 is a plan view of the arrangement of latticed web in a dome-type pressurized or unpressurized self-supporting membrane structure.
Figure 16:
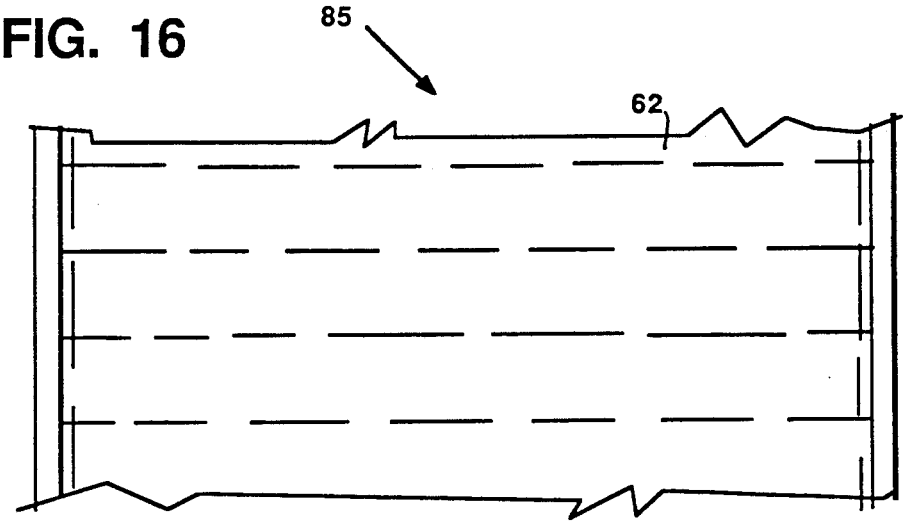
FIG. 16 is a similar plan view of the latticed web arrangement for the tunnel-type unpressurized self-supporting membrane structure.
Figure 17:
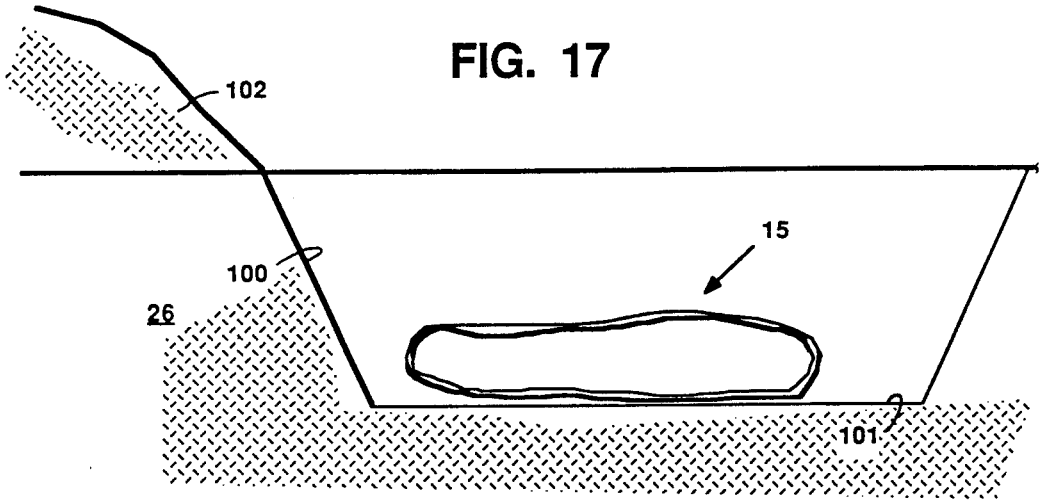
FIG. 17 is a view in elevation and section illustrating the excavation and initial installation of self-supporting membrane structure like those of FIGS. 1—4.
Figure 18:
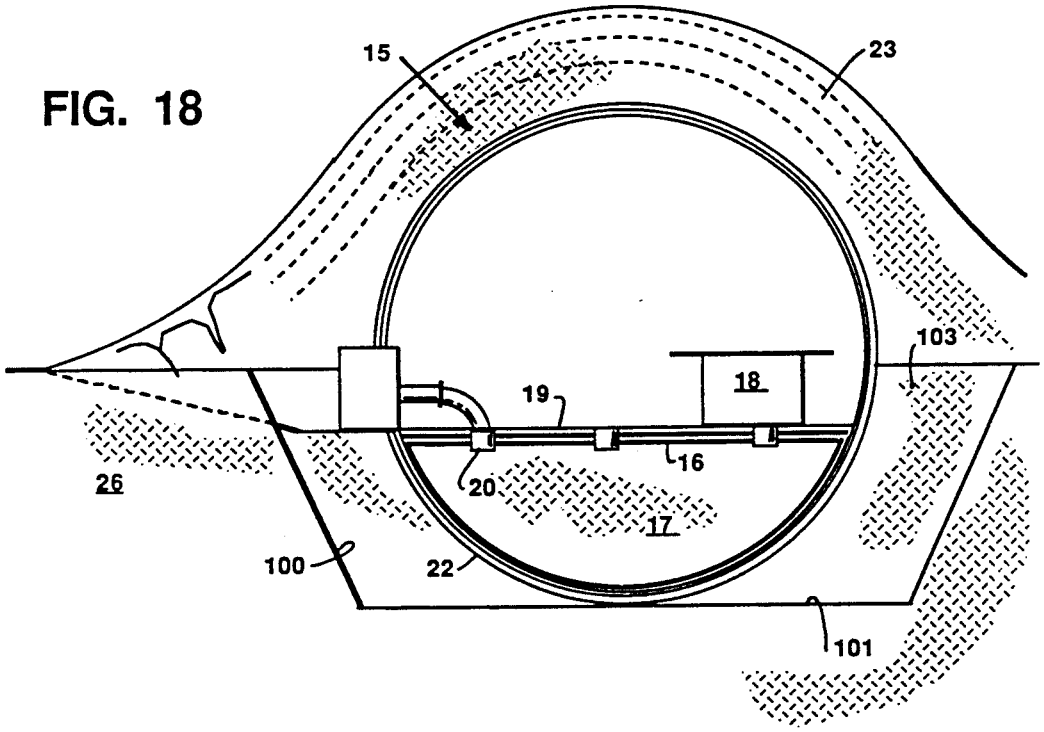
FIG. 18 is a similar view with the excavation filled after inflating and otherwise processing the membrane.

FIGS. 15 and 16 are plan views of the structures 80 and 85 showing the two layers of outer skin with the latticed webs in between, extending mostly radially in FIG. 15 with some arcuate portions, and mostly laterally in FIG. 16. Other arrangements are, of course, feasible.

Installation

A simple pressurized self-supporting membrane

The self-supporting membrane structure 15 or 30 may be brought from earth as a flat or even as a folded unit so long as adequate care is taken to prevent any weakening creases.

When unloaded on the moon and brought near a chosen location, the lunar soil 26 is excavated, providing an excavation 100 of a desired depth 101. This may be done by any suitable machinery, including the aforementioned conveyor structure. The excavated soil 102 is preferably placed at one side of the excavation 100, which provides a base 10.

The soil bag 16 may be filled with lunar soil 17. Air locks 21 may be installed, and the floor 19 prepared, and equipment 18 and 20 to be used inside the structure is maybe brought in. A passageway may be left, if desired, so long as it can be brought into the air lock entrance 21. The pressure is then adjusted to a desired pressure, such as about 14 psi inside pressure.

The space between the two skins 41 and 42 is then filled with inflating foam 45, and described earlier. Next, the sphere 15 or 30 is covered with an up to ten-foot layer 23 of lunar soil, as described earlier.

A second example of installation (FIGS. 19–21)

FIG. 19 shows stage one of an installation method used when there is a collapsed ring girder 60. The first step is to excavate and shape the ground 110 to the required depth The ground may be shaped to lie as a concave spherical or prolate spheroidal segment 111. A structure 112 which has been carried from the earth is then laid on the prepared ground 111 and secured, as by stakes 113; the structure 112 is the pulled out to be in its extended anchored position.

As shown in FIG. 20, the inside of the ring girder 60 is then pressurized to result in a circular toroidal shape. Next, the interstices between the skins 61 and 62 of the ring girder 60 are inflated with air or suitable gases to separate the two layers 61 and 62 of skin. At that point structural foam 63 may be sprayed into the space between the suitable intervals around the circumference of the structure 112. The intervals depend upon the exact size of the unit 112 being installed. After that is done, air locks 115 and other penetrations may be installed. At this stage the main structure 112 is still left in a collapsed state.

FIG. 21 shows the final stages of installation. The self-supporting membrane structure 112 is then inflated, and the interstices between the web members are inflated with air or simple gases, as for the ring girder 10. Also, as in the ring girder 60 structural foam 116 is placed in the between-skin layers at suitable intervals. The lower bag 117 is then filled with compacted soil 118. After that, flooring 120 may be laid, and the structure completed internally, as previously discussed. Then the ten-foot layer 121 of lunar soil, with or without fabric layers, may be provided.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. A self-supporting membrane structure adapted for habitation and operation in an environment of essentially zero atmospheric pressure, comprising:

an inflated, pressurized, leak-proof fabric spherical structure having upper and lower portions and capable of withstanding temperatures of about −190° C. to about +140° C., a quantity of soil overlaying and supporting the lower portions of said spherical structure, and a soil cover of up to ten feet extending over the upper portion of said spherical structure.

2. The membrane structure of claim 1 wherein the internal pressure within said structure is maintained at about 14 psia.

3. The structure of claim 1 having an interior soil bag filled with soil inside and at the bottom of said spherical structure, and a floor supported above the upper end of said soil bag.

4. The structure of claim 1 wherein said spherical structure constitutes:

a double skin membrane, the two skins being connected by latticed webs, and, in between the two skins, a filling of insulation.

5. The structure of claim 4 having an outer covering of another membrane specially treated to provide resistance to radiation, abrasion and puncture, to protect said skin membrane.

6. The structure of claim 1 in which the membrane structure is a sphere.

7. The structure of claim 7 having an internal ring girder therearound, and said membrane constitutes an upper membrane and a lower membrane, lapped and sealed to said ring girder.

8. The structure of claim of claim 7, wherein said ring girder is in the form of a circular pipe.

9. The structure of claim 1 wherein, in between said soil bag and said air-filled membrane structure, there is a space for storage between an upper floor thereabove and a lower floor therebelow.

10. A self-supposing membrane structure adapted for habitation and operation, in an environment of essentially zero atmospheric pressure, comprising:

a continuous leak-proof fabric structure having upper and lower portions and capable of withstanding temperatures of about −190° C. to about +140° C., said structure having a skin, comprised of two spaced apart fibrous skins with a latticed web between them and foam material filling the space between said skins, a quantity of soil overlaying and supporting the lower portions of said spherical structure, and a soil cover of up to ten feet extending over the upper portion of said spherical structure.

11. The membrane structure of claim 10 wherein said structure is pressurized internally to a pressure of about 14 psia.

12. The structure of claim 10 in which the membrane structure is a sphere.

13. The structure of claim 10 in which the structure is a prolate spheroid having a ring girder internally therearound in contact with said membrane.

14. The structure of claim 13, wherein said ring girder is in the form of a circular pipe.

15. The structure of claim 10 having an interior soil bag filled with soil inside and at the bottom of said spherical structure, and a floor supported above the upper end of said soil bag.

16. The structure of claim 10 wherein, in between said soil bag and said air-filled membrane structure, there is a space for storage between an upper floor thereabove and a lower floor therebelow.

* * * * *